United States Patent [19]

Kakuta

[11] Patent Number: 4,905,633

[45] Date of Patent: Mar. 6, 1990

[54] AIR COOLING MECHANISM FOR INTERNAL CENTER OF INTERNAL COMBUSTION ENGINE

[76] Inventor: Yoshiaki Kakuta, 1-8-1, Hamakawado, Kasukabe-Shi, Saitama-Ken, Japan

[21] Appl. No.: 195,834

[22] Filed: May 19, 1988

[30] Foreign Application Priority Data

Oct. 16, 1987 [JP] Japan ..... 62-261063

[51] Int. Cl.[4] ..... F01P 7/04

[52] U.S. Cl. ..... 123/41.64; 123/41.7; 417/159; 60/319

[58] Field of Search ..... 123/41.62, 41.64–41.67, 123/41.7; 60/319; 417/151, 159, 198

[56] References Cited

U.S. PATENT DOCUMENTS

| | | | |
|---|---|---|---|
| 862,250 | 8/1907 | Herman | 123/41.64 |
| 1,025,251 | 5/1912 | Desmond | 123/41.64 |
| 1,282,590 | 10/1918 | Kernohan | 123/41.64 |
| 1,424,234 | 8/1922 | Bowen | 123/41.64 |
| 1,473,668 | 11/1923 | Byrnes | 123/41.64 |
| 1,800,927 | 4/1931 | Brittain | 123/41.64 |
| 1,867,802 | 7/1932 | Bogert | 60/319 |
| 2,110,986 | 3/1938 | Kadenacy | 60/32 |
| 2,161,895 | 6/1939 | Brenner | 417/151 |
| 2,188,444 | 1/1940 | Sauer | 123/41.64 X |
| 2,586,788 | 2/1952 | Cushman | 181/43 |
| 3,234,924 | 2/1966 | May | 123/97 |
| 3,778,864 | 12/1973 | Scherer | 417/159 |
| 3,969,895 | 7/1976 | Krizman | 60/312 |
| 4,060,985 | 12/1977 | Fukushima | 60/319 |

FOREIGN PATENT DOCUMENTS

| | | | |
|---|---|---|---|
| 832895 | 10/1938 | France | 123/41.64 |
| 1263892 | 10/1986 | U.S.S.R. | 60/319 |
| 6853 | of 1908 | United Kingdom | 123/41.66 |
| 258 | of 1913 | United Kingdom . | |
| 292355 | 6/1927 | United Kingdom . | |

*Primary Examiner*—Noah P. Kamen

*Attorney, Agent, or Firm*—Fleit, Jacobson, Cohn, Price, Holman & Stern

[57] ABSTRACT

An air cooling mechanism for an internal combustion engine which has cooling jackets for cooling the internal center of the engine with air, an atmospheric air inlet to the cooling jackets and an air suction unit in the exhaust system for drawing air into the cooling jackets and exhausting air from the jackets and having a structure so that the air is forcibly drawn through the jackets for cooling the engine. The energy for drawing the cooling air is obtained by accelerating the exhaust gas stream and utilizes the intake energy responsive to the power demand of the engine and does not consume power from the engine.

6 Claims, 2 Drawing Sheets

AIR COOLING MECHANISM FOR INTERNAL CENTER OF INTERNAL COMBUSTION ENGINE

RELATED INVENTIONS

This application is related to copending Applications Ser. No. 07/219,247, U.S. Pat. No. 4,864,825 and Ser. No. 07/219,248 filed July 15, 1988, still pending, and Ser. No. 210,857 filed June 24, 1988, still pending in the name of the same inventor.

BACKGROUND OF THE INVENTION

1. Field of the Invention

This invention relates to a mechanism for cooling the internal center of an internal combustion engine directly with air.

2. Description of the Prior Art

It is known to employ air cooling in an internal combustion engine, and air cooling is particularly employed frequently in the small-sized engine for generating less quantity of heat. As the engine is increased in size, water or oil cooling of a liquid-cooling type is mostly employed. However, the coolant is mostly water. Since the boiling point of the water has less difference from the ordinary temperature of the engine when operated, the coolant immediately arrives at the boiling point if the load is increased or the engine is rotated at high speed to feasibly cause an overheating phenomenon to occur in the engine. The other disadvantages of the liquid-cooling type are that its structure is complicated, sealing devices for preventing the liquid from leaking under temperature changes at approximately 100° C. must be provided, and its maintenance is complicated due to management of the quality and components of the coolant.

A radiator is required to lower the temperature of the cooolant in the liquid-cooling type, where the heat is exchanged with air. Since the mean temperature of the atmospheric air is approximately 20° C. and approximately 50° C. under the most severe conditions, there is sufficient temperature difference between the air and the boiling point of the coolant in the liquid-cooling type, and water is almost inexhaustibly available.

SUMMARY OF THE INVENTION

The present inventor has performed studies and development of techniques for cooling the internal center of an engine directly with air due to the above-mentioned points. As a result, the inventor has discovered the fact that cooling the internal center of the engine not by natural air cooling as in existing air cooling, but by forced air cooling is excellent, which resulted in the present invention.

An object of this invention is to provide an air cooling mechanism for an internal combustion engine which can directly cool the internal center of the engine with air by forcibly introducing cooling air to the internal center of the engine and exhausting the air.

The above object of the invention can be achieved by an air cooling mechanism for an internal combustion engine comprising a plurality of air jackets provided around a combustion chamber of an engine body, an air inlet conduit for connecting the air jackets to an atmospheric air inlet, and an exhaust conduit connected to an air suction unit for heated air exhausted from the air jackets.

The air jacket described above can be considered to have a role similar to that of a water jacket in a conventional liquid-cooled engine, and the air passing through the air jacket cools the periphery of the combustion chamber of a heat generator, i.e., the internal center of the engine.

The intake and the exhaust of cooling air are important factors, and one of the features of the present invention is to provide cooling air by the engine intake. As a result the air after cooling the engine is exhausted very readily through the exhaust system and, low temperature cooling air can be efficiently introduced to the air jacket to provide the cooling effect according to the present invention. Negative pressure (vacuum) necessary to draw the cooling air through the cooling system is obtained by utilizing the exhaust gas stream, in which case, the efficiency of the entire engine becomes the highest. If electric power or a rotary force is produced from the engine to rotate a fan to convert it to the negative pressure, the utility efficiency of the engine power is reduced.

A great difference between the air cooling mechanism of the invention and the conventional air cooling mechanism resides in the fact that the cooling effect of the latter depends upon the relative speed between the moving means for carrying the mechanism and the ambient air, whereas the cooling effect is obtained even in a standing state in the mechanism of the present invention.

In the mechanism of the invention, when the engine body 10 is operated, negative pressure is formed in the negative pressure generator 40 as the exhaust gas stream is exhausted from the exhaust manifold. As a result, the stream of the cooling air directed from the atmospheric air inlet 20 through the air jackets 1*a*, . . . , 1*d* of the engine body 10 and the exhaust conduit 30 toward the downstream of the muffler 51 is forcibly generated.

The atmospheric air purified and introduced through the inlet 20 is fed to the air jackets 1*a*, . . . 1*d* surrounding the internal center where its temperature is raised by the heat of combustion thermally exchanged from the high temperature of the internal center to the atmospheric air due to a large temperature difference to thus cool the internal center of the engine body. The cooling air is drawn through the exhaust conduit 30 by the negative pressure generator 40 which exhausts the cooling air downstream of the muffler 51. There arises an advantage that the exhaust gas temperature can be reduced by the air stream combining with the exhaust gas at the downstream side of the muffler.

When the rotating speed of the engine is increased, the temperature at the internal center of the engine body is increased and the velocity and flow rate of the exhaust gas stream are also increased to obtain stronger negative pressure, thereby increasing the cooling effect. When constructed as shown in FIG. 4, the air stream outside the engine can be utilized, whereby the intake effect is further enhanced.

Therefore, according to the present invention, there is obtained an effect of maintaining the internal center of the engine body at a temperature adapted to operate the engine by forcibly cooling the internal center of the engine directly with air. Further, since negative pressure produced by the exhaust gas stream of the engine can be utilized to forcibly cool it, the loss of power of the engine is not present which results in an extremely high efficiency.

According to the present invention, countermeasures for liquid circulation and liquid leakage necessary for cooling by liquid are entirely unnecessary, maintenance is remarkably simplified, the weight of the engine is significantly reduced, and the cooling effect is very rapidly produced.

BRIEF DESCRIPTION OF THE DRAWINGS

The invention will now be described in detail with reference to the accompanying drawing wherein.

DESCRIPTION OF THE PREFERRED EMBODIMENTS

Figure 1:
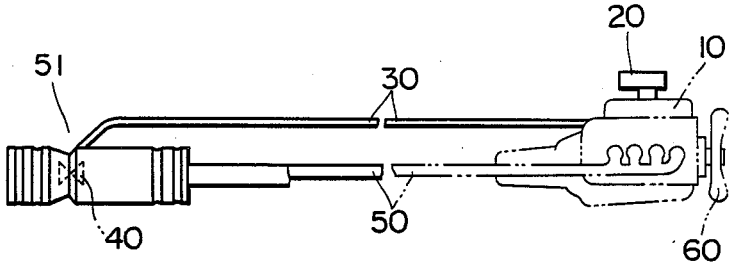
FIG. 1 is a schematic elevational view of an embodiment of an entire structure of an air cooling mechanism for the internal center of an internal combustion engine according to the present invention.
Figure 2:
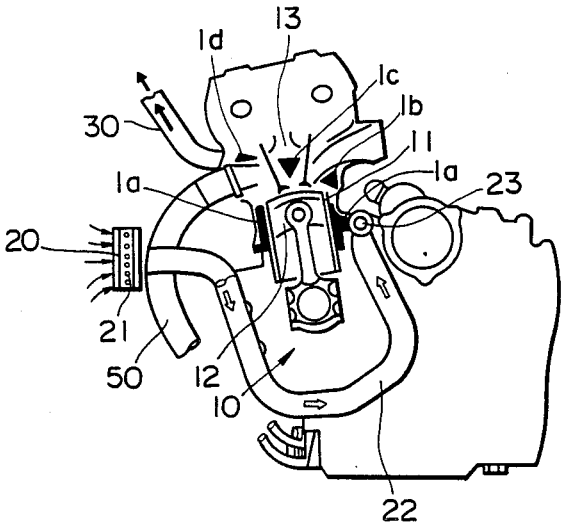
FIG. 2 is a schematic cross-sectional view of the engine body of the embodiment.

The invention will be described with respect to an embodiment of an air cooling mechanism for the internal center of an internal combustion engine according to the present invention with reference to the accompanying drawings wherein, reference numeral 10 designates an engine body in which air cooling is carried out, numeral 20 denotes an atmospheric air inlet, numeral 30 denotes an exhaust conduit for heated air after heat exchanging, and numeral 40 indicates a negative pressure generator of an air suction unit, provided in a muffler generally shown at 51 of an exhaust manifold 50.

Air jackets 1*a*, 1*b*, 1*c*, 1*d*, . . . are respectively provided in the engine body 10 so as to surround the peripheries of heat generators, such as a cylinder 1, a piston 12, a cylinder head 13, etc. Air introduced from the atmospheric air inlet 20 and purified by a filter 21 is introduced through one or more ports 23 and an air inlet conduit 22 into all the jackets 1*a*, . . . 1*d*. A conduit 30 is connected at its inlet end to the air jackets 1*a*, . . . 1*d* to exhaust the air after passing through the heat exchangers, and the outlet end of the conduit 30 is connected to the negative pressure generator 40.

Figure 3:
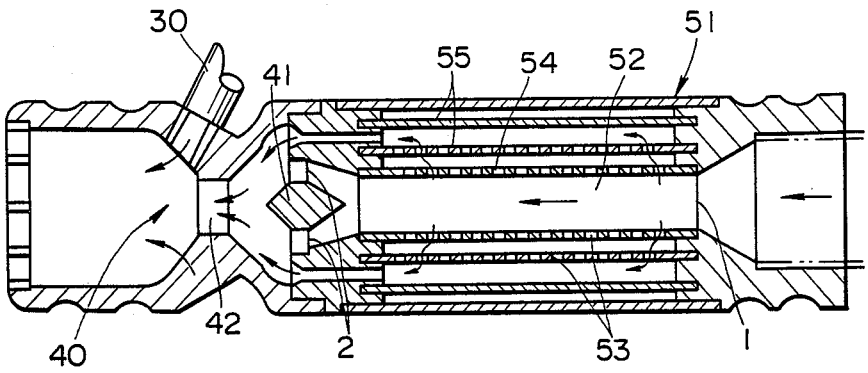
FIGS. 3 and 4 are longitudinal cross sectional views of two embodiments of a negative pressure generator of the invention.
Figure 4:
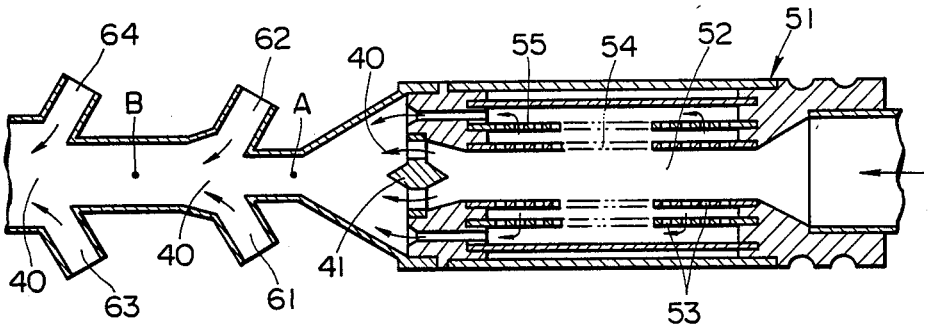

The negative pressure generator 40 is constructed as shown in the embodiments of FIGS. 3 and 4. FIG. 3 shows an example of forming negative pressure only by an exhaust gas stream. The negative pressure generator 40 has a conical accelerator 41 provided at the upstream side of a throttle 42 for throttling the cross sectional area of the exhaust gas stream flow passage, and the exhaust conduit 30 connected to the downstream side of the throttle 42. Reference numeral 52 designates the main passage of the muffler 51, numeral 53 denotes pores for silencing sounds, and numerals 54 and 55 depict inner and intermediate cylinders for forming a bypass passage to which an exhaust gas stream is fed through the pores 53.

FIG. 4 shows an example of forming negative pressure responsive to the velocity of air during the operation, having acceleration conduits 61, 62, 63 and 64 for introducing the atmospheric air in multiple stages in addition to the construction similar to that in FIG. 3. Thus, stronger negative pressure can be produced.

Reference numeral 60 designates a fan, which may be auxiliarily used arbitrarily. When the fan 60 is used, the natural air cooling of the outside of the body 10 is accelerated.

What is claimed is:

1. An air cooling apparatus for an internal combustion engine having heated parts heated by operation of the engine and an exhaust system including an exhaust muffler comprising:

at least one air cooling jacket around at least one of the heated parts of the engine in heat exchange relation with said at least one heated part;

an inlet for said at least one cooling jacket for introducing atmospheric air into said jacket;

an outlet for said at least one cooling jacket for the discharge of air therefrom;

negative pressure generator means in the exhaust system connected downstream of the muffler for receiving engine exhaust gas flow from the muffler and thereby producing negative pressure, said negative pressure generator means further comprising at least one ambient air inlet means communicating with the exhaust gas flow for utilizing velocity of said negative pressure generator means relative to the ambient air to enhance the negative pressure generated; and discharge conduit means having an inlet end connected to said cooling jacket outlet and a discharge end connected to said negative pressure generator means downstream of said ambient air inlet means, so that negative pressure produced by said negative pressure generator means draws air through said at least one cooling jacket inlet, said at least one cooling jacket and said discharge conduit for cooling said at least one heated part of the engine.

2. An air cooling apparatus as claimed in claim 1 wherein said negative pressure generator means comprises:

a housing having a hollow interior through which engine exhaust gas flows;

accelerator means in said housing in the flow path of the engine exhaust gas for increasing the flow velocity thereof; and a negative pressure zone in said housing downstream of said accelerator means for receiving the engine exhaust gas at the increased flow velocity thereof;

said discharge end of said discharge conduit being connected to said housing in communication with said negative pressure zone.

3. An air cooling apparatus as claimed in claim 2 wherein said at least one ambient air inlet means comprises:

a plurality of ambient air intake means connected to said housing and communicating with said negative pressure zone for conducting atmospheric air into the engine exhaust gas flow in response to the velocity of said housing relative to the surrounding air.

4. An air cooling apparatus as claimed in claim 2 wherein:

said accelerator means comprises a reducing section decreasing the cross-sectional area of said hollow interior of said housing through which the engine exhasut gas flows; and said negative pressure zone comprises an enlarged section increasing the cross-sectional area of said hollow interior of said housing downstream and adjacent to said reducing section.

5. An air cooling apparatus as claimed in claim 4 wherein:

said reducing section comprises a diverging conical member mounted in said housing in the engine exhaust gas flow path; and said accelerator means further comprises a truncated converging conical section in said hollow interior of said housing adjacent to and downstream of said diverging conical member; and a cylindrical flow section between said truncated converging conical section and said negative pressure zone.

6. An air cooling apparatus as claimed in claim 5 wherein said at least one ambient air inlet means comprises:

a plurality of ambient air intake means connected to said housing downstream of said reducing section and communicating with said negative pressure zone for conducting atmospheric air into the engine exhaust gas flow in response to the relative velocity of said housing and surrounding air.

* * * * *